US008421633B2

(12) United States Patent
Yang

(10) Patent No.: US 8,421,633 B2
(45) **Date of Patent: *Apr. 16, 2013**

(54) CLASPING ANTI-THEFT DEVICE WITH ALARM FEATURES

(76) Inventor: Xiao Hui Yang, Saratoga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/614,208

(22) Filed: Sep. 13, 2012

(65) Prior Publication Data

US 2013/0002430 A1 Jan. 3, 2013

Related U.S. Application Data

(63) Continuation of application No. 12/754,031, filed on Apr. 5, 2010, now Pat. No. 8,269,631, which is a continuation-in-part of application No. 12/726,879, filed on Mar. 18, 2010, now Pat. No. 8,305,219, which is a continuation-in-part of application No. 12/498,367, filed on Jul. 7, 2009, now Pat. No. 8,274,391, which is a continuation-in-part of application No. 12/391,222, filed on Feb. 23, 2009, now Pat. No. 8,144,014.

(60) Provisional application No. 61/030,932, filed on Feb. 22, 2008, provisional application No. 61/030,929, filed on Feb. 22, 2008.

(51) Int. Cl.
*G08B 13/14* (2006.01)

(52) U.S. Cl.
USPC ..... 340/572.9; 340/426.1; 340/539.1

(58) Field of Classification Search ..... 340/572.9, 340/572.1, 426.1, 542, 568.1, 539.1, 549, 340/545.1, 545.6
See application file for complete search history.

(56) References Cited

U.S. PATENT DOCUMENTS

| | | | | |
|---|---|---|---|---|
| 931,685 | A | 8/1909 | Crim | |
| 1,347,467 | A | 7/1920 | Scott | |
| 3,966,033 | A | 6/1976 | Doo | |
| 3,995,900 | A | 12/1976 | Humble et al. | |
| 4,398,404 | A | 8/1983 | Wake | |
| 4,574,600 | A * | 3/1986 | Moffett | 70/16 |
| 6,018,968 | A * | 2/2000 | Sides | 70/14 |
| 6,057,762 | A | 5/2000 | Dusza | |
| 6,374,647 | B1 | 4/2002 | Holmgren | |
| 6,845,640 | B2 * | 1/2005 | Loeff et al. | 70/63 |
| D523,729 | S | 6/2006 | Gorst | |
| 7,068,172 | B2 | 6/2006 | Yang et al. | |
| 7,134,302 | B2 | 11/2006 | Gorst | |
| 7,190,272 | B2 | 3/2007 | Yang et al. | |

(Continued)

*Primary Examiner* — Daniel Previl
(74) *Attorney, Agent, or Firm* — Robert R. Waters; Brian W. Foxworthy; J. Michael Wells

(57) ABSTRACT

An anti-theft device monitors objects having a shaft, strap, or similar element. The anti-theft device is comprised of a two components hingably connected together. The two components can move from an open position to a closed position to enclose the shaft or similar element. One component has a first latch element and contains electronics including an arming switch. When the two components are moved to the closed position, the other component changes the status of the arming switch. The other component has a second latch element which combines with the first latch element to hold the two components in the closed position. The anti-theft device may be armed or disarmed by a remote device. The latching elements may be releasably lockable and may be released by a magnet. The anti-theft device may have passcode protection capabilities.

21 Claims, 6 Drawing Sheets

U.S. PATENT DOCUMENTS

| | | | |
|---|---|---|---|
| 7,249,401 | B2 | 7/2007 | Copen et al. |
| 7,266,979 | B2 | 9/2007 | Belden, Jr. |
| 7,400,254 | B2 | 7/2008 | Yang et al. |
| 7,412,857 | B2 | 8/2008 | Kolton et al. |
| D578,030 | S | 10/2008 | Yang et al. |
| 7,458,241 | B2 | 12/2008 | Belden, Jr. |
| 7,474,222 | B2 | 1/2009 | Yang et al. |
| 7,498,945 | B2 | 3/2009 | Marsilio et al. |
| D599,242 | S | 9/2009 | Yang |
| 7,650,768 | B2 * | 1/2010 | Fawcett et al. ..... 70/58 |
| 8,269,631 | B2 * | 9/2012 | Yang ..... 340/572.1 |
| 2006/0070410 | A1 | 4/2006 | Fuss et al. |
| 2009/0058659 | A1 | 3/2009 | Handyside et al. |
| 2009/0160644 | A1 | 6/2009 | Yang |
| 2009/0212920 | A1 | 8/2009 | Yang |
| 2009/0212952 | A1 | 8/2009 | Yang |
| 2009/0289798 | A1 | 11/2009 | Yang |
| 2010/0052910 | A1 | 3/2010 | Yang |

* cited by examiner

CLASPING ANTI-THEFT DEVICE WITH ALARM FEATURES

CROSS REFERENCE TO RELATED APPLICATIONS

This application is a continuation application based on U.S. patent application Ser. No. 12/754,031 filed on Apr. 5, 2010, and issued as U.S. Pat. No. 8,269,631 on Sep. 18, 2012. U.S. patent application Ser. No. 12/751,031 is a continuation-in-part application based on U.S. patent application Ser. No. 12/726,879 filed on Mar. 18, 2010, and issued as U.S. Pat. No. 8,305,219 on Nov. 6, 2012. U.S. patent application Ser. No. 12/726,879 is a continuation-in-part of U.S. patent application Ser. No. 12/498,367, filed on Jul. 7, 2009, and issued as U.S. Pat. No. 8,274,391 on Sep. 25, 2012. U.S. patent application Ser. No. 12/498,367 is a continuation-in-part application based on U.S. patent application Ser. No. 12/391,222 filed on Feb. 23, 2009, and issued as U.S. Pat. No. 8,144,014 on Mar. 27, 2010. U.S. patent application Ser. No. 12/391,222 in turn claims priority to U.S. Provisional Application 61/030,932, filed on Feb. 22, 2008, and U.S. Provisional Application 61/030,929 filed on Feb. 22, 2008. The entire disclosures contained in U.S. patent application Ser. No. 12/754,031, U.S. Pat. No. 8,269,631, U.S. patent application Ser. No. 12/726,879, U.S. Pat. No. 8,305,219, U.S. patent application Ser. No. 12/498,367, U.S. Pat. No. 8,274,391, U.S. patent application Ser. No. 12/391,222, U.S. Pat. No. 8,144,014, U.S. Provisional Application 61/030,932, and U.S. Provisional Application 61/030,929, including the attachments thereto, are incorporated herein by reference.

FIELD OF INVENTION

The present application is generally related to an anti-theft tag, and more specifically, an anti-theft tag that attaches to objects having a shaft or similar element by encircling that element. Also, the tag of the present application may be used with various electronic article surveillance (EAS) systems, including for example, an EAS system utilizing tags and deactivators featuring infrared communication for deactivation and alarming and featuring dynamic time based passcode modification and other tamper resistant features, and/or an EAS system using passive element technology. In certain applications the mere presence of the tag may be deemed to be sufficient deterrence from theft and in those applications the anti-theft tag may actually not have any EAS electronics.

SUMMARY OF EMBODIMENTS OF THE INVENTION

The present invention is for an anti-theft electronic article surveillance tag having two hinge components hingably attached to each other. The two hinge components can move from the many open positions of an open state to the closed position of a closed state. When in the closed position the two components combine to form a passageway which can receive a shaft or other element of an object to be protected. A housing is attached to one component, while a cover is attached to the other component. When the two components are in the closed position, the cover covers the top of the housing. Latching components on the housing and cover interact to keep the housing and cover engaged and the two components in the closed position. These latching components are releasable so that the anti-theft tag may be removed from an object by an authorized person. The housing may also contain a blocking component to lock the latching components in position to prevent them from being disengaged without authorization. This blocking component is releasable as well.

The housing contains an internal compartment which holds several electronic components. Among the electronics components is a cover switch. The housing has an aperture through its top and the cover switch protrudes through this aperture to extend out the top of the housing. When the two components are in the closed position and the cover covers the top of the housing, the cover changes the status of the cover switch. This change in status of the cover switch is recognizable and usable by the other electronics components.

Among the other electronics which may be contained in the electronics compartment of the housing of the anti-theft tag are: a microprocessor, a circuit board, a battery, an EAS core and coil element, a latch switch, an audible alarm producing device, an infrared communication port or other communication elements, and a light emitting diode. The microprocessor or circuit board can detect when the cover switch undergoes a change in state. If the electronics also comprise a latch switch associated with the latching elements, the electronics monitor the switch for the latched or unlatched status of the tag. If the change in state of the cover switch indicates that the cover is over the top of the housing, the tag may be armed. In some embodiments, the EAS tag may be armed with an external device that communicates with the tag via the infrared communication port, other wireless communication such as radio frequency communication, or other communication elements. In some embodiments, the latch switch detects when the latch has been engaged and the combination of the cover switch and the latch switch arms the electronics. In some embodiments, the electronics may arm based on the state of the cover switch itself. The external device can be a hand held remote communication device or a device associated with a base station.

Once armed, if the electronics detect an unauthorized change in status, the electronics can determine an alarm condition and issue an alarm. For example, if a tag is removed from a protected object, and the cover is removed from the top of the housing, the status of the cover switch will change. If an authorization signal is not previously received by the tag, the electronics will determine an alarm condition and issue an alarm. This alarm may be an audible alarm or an alarm broadcast to a respective receiver in an electronic article surveillance anti-theft system. The broadcast may be by infrared communications, radio frequency communications, or other wireless type communications.

Disarming of the EAS tag may be accomplished by authorized personnel. An authorized person having access to other elements of the EAS system such as a hand held communication device or a base station having communication capabilities may disarm the device. Some embodiments will add another element of security with passcode capabilities in the respective electronics. The EAS tag electronics of these embodiments are capable of storing a passcode which is known to the communication elements of the EAS system and which can be used to confirm to the EAS tag that the disarming signal is authorized. A further element of security can be added by using clock based algorithms to change the passcode synchronously. In those embodiments, the EAS system and the EAS tag both have clock generators and are programmed with the same algorithm and both are programmed with the same initial passcode. As time passes, the algorithm alters the passcode at preset intervals as regulated by the clock generators. This changing passcode further complicates unauthorized attempts to disarm the EAS tag. If an EAS tag is detached without being disarmed with the appropriate passcode, the EAS tag will detect an alarm condition and generate an alarm.

To physically prevent the release of the latch and the detaching of the housing portion from the base portion, a blocking component or mechanism may be employed. In one embodiment, a biased blocking member moves into a blocking position when the latch engages between the housing and the cover. The biased blocking member has a magnetically attractable element associated with it, and when a magnet is applied to the EAS tag, the biased blocking member moves to a position where it no longer blocks the release of the latch. If a magnet is used to detach an EAS tag without authorization and the EAS tag is still armed, the electronics detect an alarm condition and generate an alarm. In some embodiments a magnet may be built into a communication device so that the EAS tag may be disarmed and its latch released for detachment using the same device.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
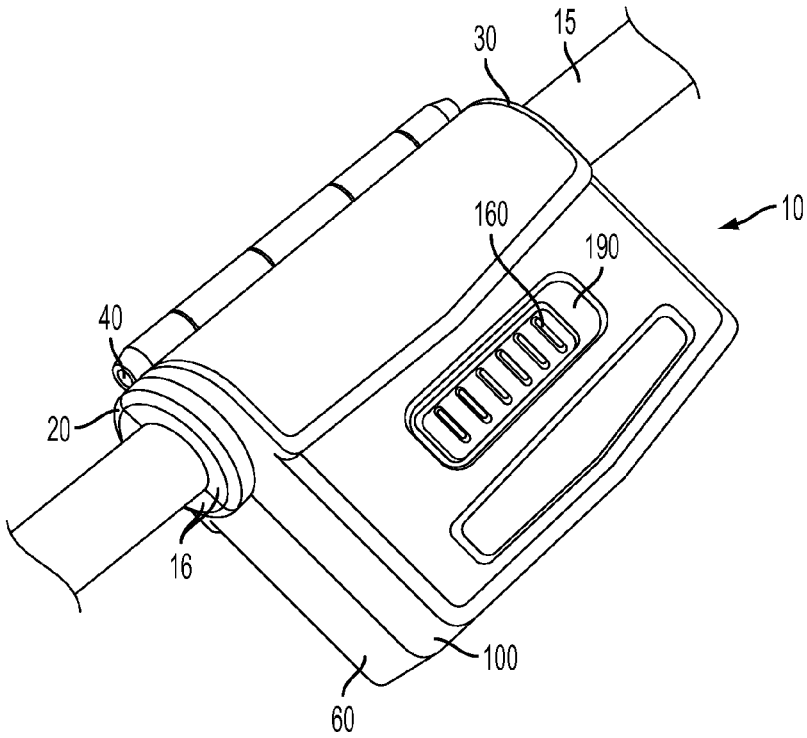
FIG. 1 shows an embodiment of an anti-theft tag of the present invention from one perspective closed around a solid member of an object to be protected.
Figure 2:
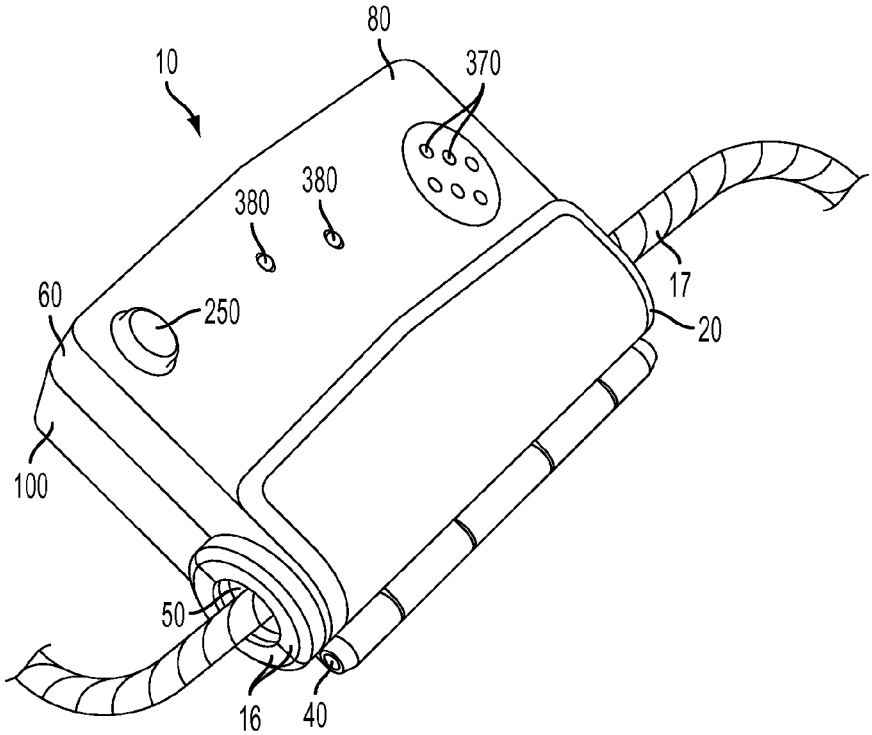
FIG. 2 shows an embodiment an anti-theft tag of the present invention from another perspective closed around a flexible member of an object to be protected.

FIG. 1 shows an embodiment of anti-theft tag 10 of the present invention from one perspective closed around a solid member 15 of an object to be protected. Solid member 15 may be a cylindrical shaft or other shape of a size that anti-theft tag 10 can accommodate. For embodiments having cushions 16, cushions 16 allow anti-theft tag 10 to accommodate a range of sizes in solid member 15 while also maintaining firm engagement with solid member 15. FIG. 2 shows an embodiment of anti-theft tag 10 of the present invention from another perspective closed around a flexible member 17 of an object to be protected. Flexible member 17 may be a cable, strap, or other flexible member of a size that anti-theft tag 10 can accommodate.

Figure 3:
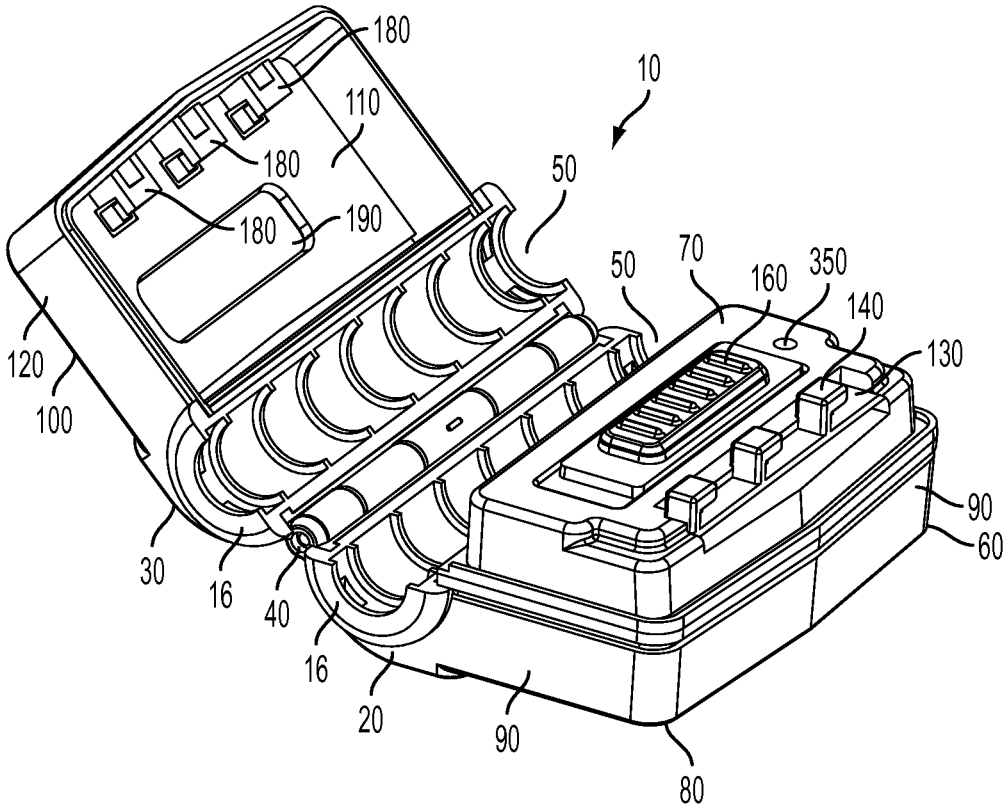
FIG. 3 shows an embodiment of the anti-theft tag of the present invention by itself in an open position.

FIG. 3 shows an embodiment of the anti-theft tag 10 of the present invention by itself in an open position. Anti-theft tag 10 has two hinge components 20, 30, hinged together at hinge axis 40. Hinge components 20, 30, can rotate about hinge axis 40 in a range between a fully open and a fully closed position. FIG. 3 shows anti-theft tag 10 in a mostly open position. FIGS. 1 and 2 show anti-theft tag 10 in a closed position. Hinge components 20, 30 are shaped in such a manner that when they are rotated to the closed position, they combine to form a passageway 50 that can accommodate portions of objects. This effectively attaches anti-theft tag 10 to the objects. As long as the portion 15, 17 of the object is of a size that it can fit through passageway 50, anti-theft tag 10 can close around that portion 15, 17 and attach to the object. Cushions 16 allow anti-theft tag 10 to accommodate a range of sizes while also maintaining firm contact with a solid member 15 as well as protecting solid member 15.

Referring now to FIG. 3, the first of the hinge components, first component 20, has housing 60 attached to it or extending from it. In the embodiment of anti-theft tag 10 shown in FIG. 3, housing 60 has a top 70, a bottom 80, and four sides 90. In the embodiment shown in FIG. 3, one of four sides 90 is shared with first component 20.

Again referring to FIG. 3, the second of the hinge components, second component 30 has cover 100 attached to, or, extending from, it. Cover 100 covers top 70 of housing 60 when first component 20 and second component 30 are rotated into a closed position. In the embodiment of anti-theft tag 10 shown in FIG. 3, cover 100 is comprised of central panel 110 having four edges and four sides 120 extending from those four edges and joining together to define an open interior of cover 100. In the embodiment of anti-theft tag 10 shown in FIG. 3, cover 100 surrounds part of housing's 60 sides 90 as well as covering housing's 60 top.

Figure 4:
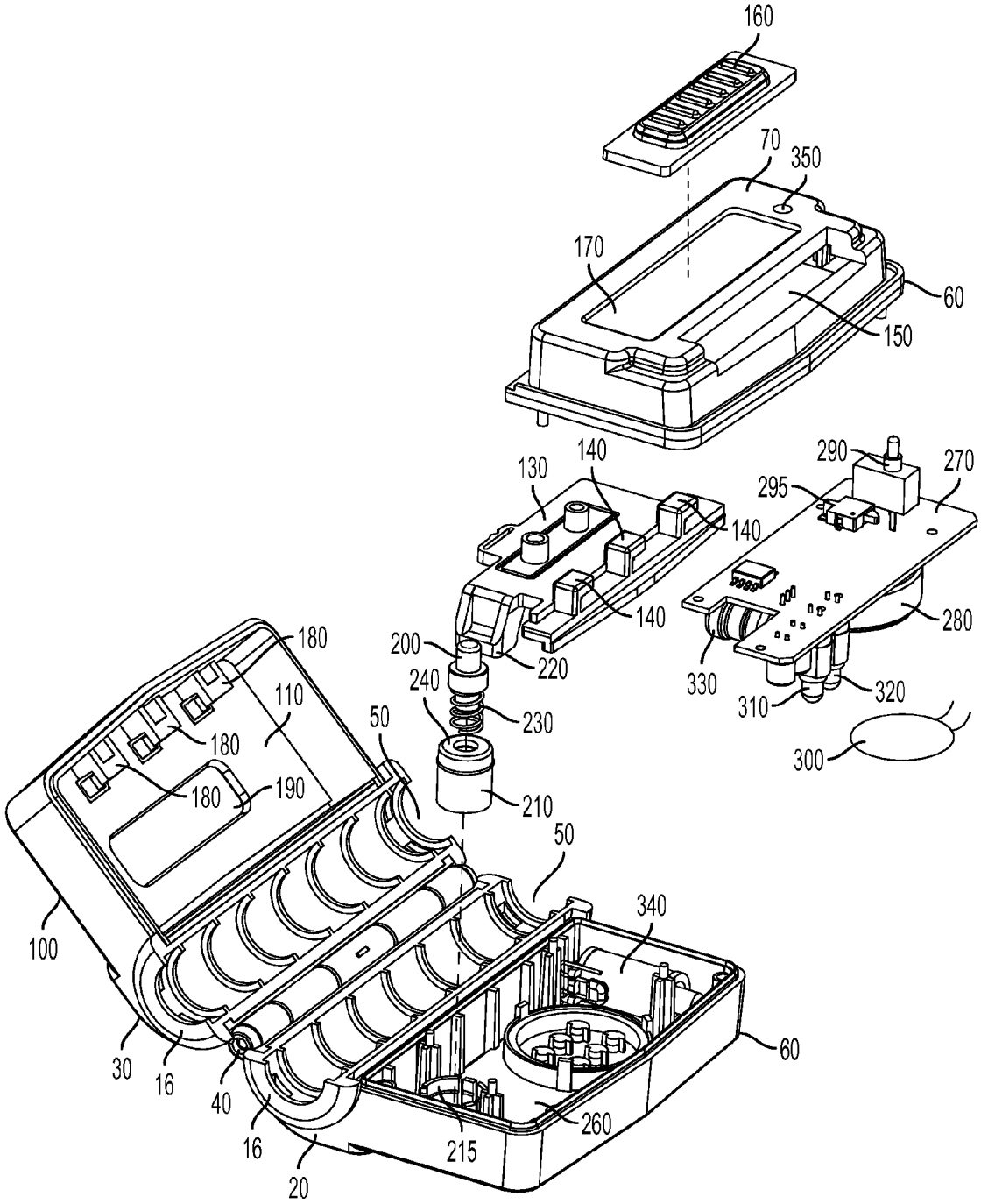
FIG. 4 is an exploded view of an embodiment of the anti-theft tag of the present invention in an open position.

FIG. 4 shows an exploded perspective view of an embodiment of anti-theft tag 10 of the present invention in an open position. Referring to both FIGS. 3 and 4, top 70 of housing 60 carries one latching component, latch 130, and panel 110 carries another latching component, latch receivers 180. In FIG. 3, latch hooks 140 of latch 130 may be seen protruding through hook aperture 150 in top 70. Latch button 160 rides on top 70 of housing 60, and latch 130 attaches to latch button 160 through button aperture 170 which is visible in FIG. 4. Button aperture 170 and hook aperture 150 are elongated to allow latch 130 to slide back and forth between an engaged position and an unengaged position. In the engaged position, latch 130 engages latch receivers 180 on panel 110 with latch hooks 140. In the embodiment shown in FIG. 4, latch 130 is manually operated back and forth between the engaged and unengaged positions. Panel aperture 190 in panel 110 allows access to latch button 160 when cover 100 is rotated to the closed position.

Referring to FIG. 4, a blocking mechanism, or component, may be seen. Blocking pin 200 is normally contained in cup 210 and biased toward tab 220 on latch 130 by spring 230. Cup 210 seats in cup seat 215. When latch 130 is in the unengaged position tab 220 on latch 130 covers cup aperture 240, restraining blocking pin 200 in a retracted position within cup 210 with spring 230 compressed. When latch 130 is moved to the engaged position, tab 220 moves off of cup aperture 240 and blocking pin 200 is moved to a blocking position at the end of tab 220, preventing latch 130 from returning to an unengaged position. Blocking pin 200 has a magnetically attractable element associated with it. To retract blocking pin 200 to allow the movement of latch 130 back to an unengaged position, a magnet is applied externally to bottom 80 of anti-theft tag 10. The magnet attracts the magnetically attractable element associated with blocking pin 200 and retracts blocking pin 200 into cup 210, compressing spring 230. When latch 130 is moved to an unengaged position with blocking pin 200 retracted, tab 220 on latch 130 covers cup aperture 240 which restrains blocking pin 200 until latch 130 is moved again. Dome 250 on bottom 80 of housing 60 provides a visual indication of where to apply a magnet to most directly align with blocking pin 200.

Housing 60 defines an internal compartment 260 within it, which may be seen in the exploded view of FIG. 4. Among the electronic elements that may be contained in electronics compartment 260 of housing 60 are: circuit board 270; microprocessor 280; cover, or closure, switch 290; latch switch 295; audible alarm generator 300; infrared communication port 310; light emitting diode 320; battery 330; as well as other electronic elements such as additional communication elements for other wireless communication techniques like radio frequency communication, etc. Internal compartment 260 may also carry a passive EAS element such as a core and coil electronic article surveillance element 340.

Figure 5:
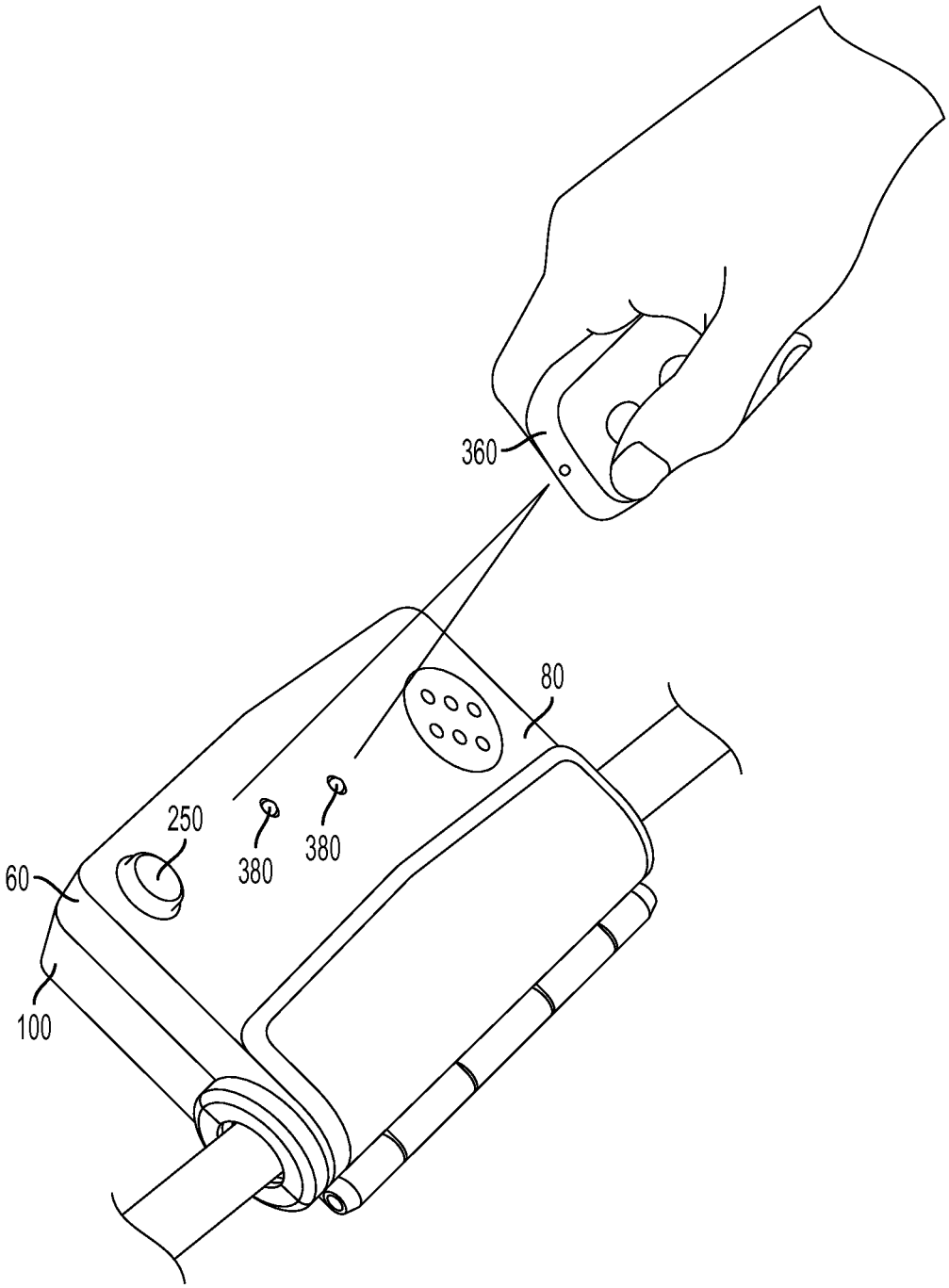
FIG. 5 shows an embodiment of the anti-theft tag of the present invention being communicated with using a hand held remote.

Top 70 has switch aperture 350 through it. Closure switch 290 protrudes through switch aperture 350 in top 70. When cover 100 covers top 70, cover 100 actuates closure switch 290 (typically cover 70 is then latched into place by latch 130). The change in the status of closure switch 290 indicates that first component 20 and second component 30 are rotated into a closed position and is detected by circuit board 270 and microprocessor 280. Anti-theft tag 10 may then be armed. In embodiments having latch switch 295, the movement of latch 130 to the engagement position will actuate latch switch 295. This actuation of latch switch 295 in combination with the prior actuation of closure, or cover, switch 290 can combine to arm anti-theft tag 10. Other embodiments of anti-theft tag 10 may be armed, after cover 100 actuates closure switch 290, by communication from an external device such as a handheld remote 360 as shown in FIG. 5. Communication between anti-theft tag 10 and handheld remote 360 may be infrared communication via infrared communication port 310, other wireless communication such as radio frequency communication, or other known methods of communication. Once anti-theft tag 10 is armed, if it is removed from the protected item without prior disarming communication, the electronics of anti-theft tag 10 will determine an alarm condition and issue an alarm. The alarm may be an audible alarm generated by audible alarm generator 300. The alarm may also be a broadcast alarm broadcast by the communication elements of the electronics to respective receivers in other components of electronic article surveillance system. The broadcast alarm may be broadcast by wireless communications such as infrared communication and radio frequency communication, or other type of communication. Receivers in the broader electronic article surveillance system such as those in base stations, hand held devices, etc. receive the broadcast alarm and can communicate to personnel with screen displays, audible alarms, etc. that an alarm condition has been determined in a tag and take appropriate action.

In FIG. 2, bottom 80 of housing 60 is visible. Bottom 80 has sound apertures 370 to provide direct access of the audible alarm to outside of housing 60. Bottom 80 of housing 60 also has sight apertures 380 to provide visibility to infrared communication port 310 and light emitting diode 320. As noted previously, dome 250 on bottom 80 provides an indication of where to apply a magnet to retract blocking pin 200. Infrared communication port 310 provides a route to communicate with EAS tag 10 via infrared communication methods. Light emitting diode 320 provides visual cues for the status of EAS tag 10.

Circuit board 270 and microprocessor 280 are capable of storing machine readable instructions and are programmable to monitor the status of EAS tag 10 and to communicate with remote programmers and other elements of an EAS system. Circuit board 270 and microprocessor 280 may be reprogrammed via communication with hand held remotes, such as handheld remote 360 in FIG. 5, or other elements of an EAS system when communicating with these devices. In the embodiment shown in FIG. 5, circuit board 270 and microprocessor 280 can communicate via infrared communication port 310 and also receive programming instructions. Audible alarm generator 300 is capable of generating an audible alarm when EAS tag 10 is tampered with, for example, in an attempted unauthorized removal of EAS tag 10, cover 100 may be separated from the top of housing 60 changing the status of closure switch 290. The change in status of closure switch 290 is detected by circuit board 270 and microprocessor 280 which can determine an alarm status for EAS tag 10 and generate an alarm signal. Audible alarm generator 300 may also be used to indicate the status of EAS tag 10 as it is installed. For example, when first component 20 and second component 30 are rotated to the closed position, cover 100 contacts top 70 of housing 60, changing the status of closure switch 290. Audible alarm generator 300 can produce a sound indicating that EAS tag 10 is installed and ready to be armed by another device such as handheld remote 360, or armed by moving latch 130 to the engaged position, which changes the status of latch switch 295. Similarly, LED 320 can be used to provide visual cues for the status of EAS tag 10. Battery 360 generally provides power for the electronic components of EAS tag 10, such as audible alarm generator 300, microprocessor 280, LED 320, etc.

EAS element 340 is a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements, such as EAS element 340, dissipate their energy and generate a signal at a designed frequency. The EAS system is capable of detecting the signal as an indication of the unauthorized presence of the passive elements and can generate an alarm based on the signal. The EAS elements 340 contained within the embodiment of EAS tag 10 in FIG. 4 is compatible with prior art and legacy systems providing an additional security mechanism. In addition to the prior art system detection of the passive EAS element 340, in some embodiments circuit board 270 and microprocessor 280 can monitor the status of passive element 340 and issue an alarm as well. If microprocessor 280 or circuit board 270 detects energy storage and dissipation activity in the coil, then audible alarm generator 300 may be instructed to generate an alarm or the communication capabilities of the electronics may be employed to broadcast a signal to respective receivers in the broader EAS system to generate an alarm. While the passive EAS element 340 shown in FIG. 4 is shown as a core and coil type of element, any passive element known in the art could be used.

Figure 6:
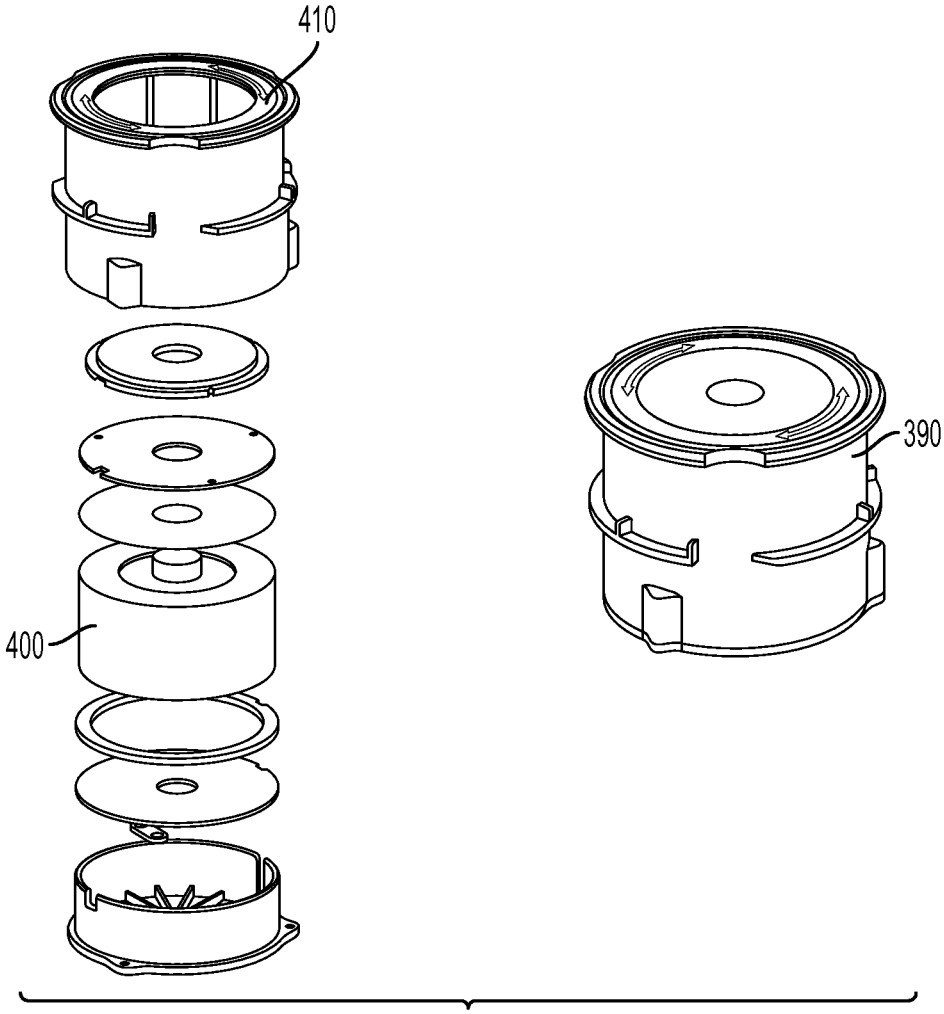
FIG. 6 shows a detacher that may be used with embodiments of the anti-theft tag of the present invention to activate, deactivate, and detach the various embodiments.

FIG. 6 shows a hand held detacher 390 that may be used with embodiments of the EAS tag 10 of the present invention to activate, deactivate, arm, disarm, and detach the various embodiments of EAS tag 10. In FIG. 6, detacher 390 is shown both assembled and exploded into components. Detacher 390 includes magnet 400 as well as some elements of handheld remote 360 described above with respect to FIG. 5. Detacher 390 also has an infrared communication 410 or other communication element. Hand held detacher 390 can communicate with EAS tag 10 to disarm it while magnet 400 of detacher 390 is placed on EAS tag 10 to actuate a release of a latching mechanism in housing 60 and release housing 60 from cover 100. Alternatively to infrared communication, radio frequency communication, or other wireless communication may be used. Once the electronics of housing 60 are disarmed, first component 20 and second component 30 can be rotated to an open position, lifting cover 100 from housing 60, which will change the status of arming switch 290, without housing 60 generating an alarm.

The electronics of some embodiments of EAS tag 10 may have passcode protection. These embodiments are capable of storing a passcode which is required to be matched by handheld remote 360 or hand held detacher 390 for various communications to be verified as authorized. For further protection the electronics of some embodiments of EAS tag 10 may include a clock generator and the electronics may have machine readable instructions with an algorithm to change the passcode at preprogrammed time intervals. The EAS system, including handheld remote 360, also has at least one clock generator and is capable of updating the passcode at the preset intervals to update the systems record of the passcode. This keeps the passcode between EAS tag 10 and the rest of the EAS system synchronized. Detacher 390 may be powered by a cable 420 connected to an element within the EAS system, or detacher 390 may simply be tethered to another object to prevent it from being mislaid or stolen. In some embodiments cable 420 will provide communication capabilities between a base station and EAS tag 10 via detacher 390.

Figure 7:
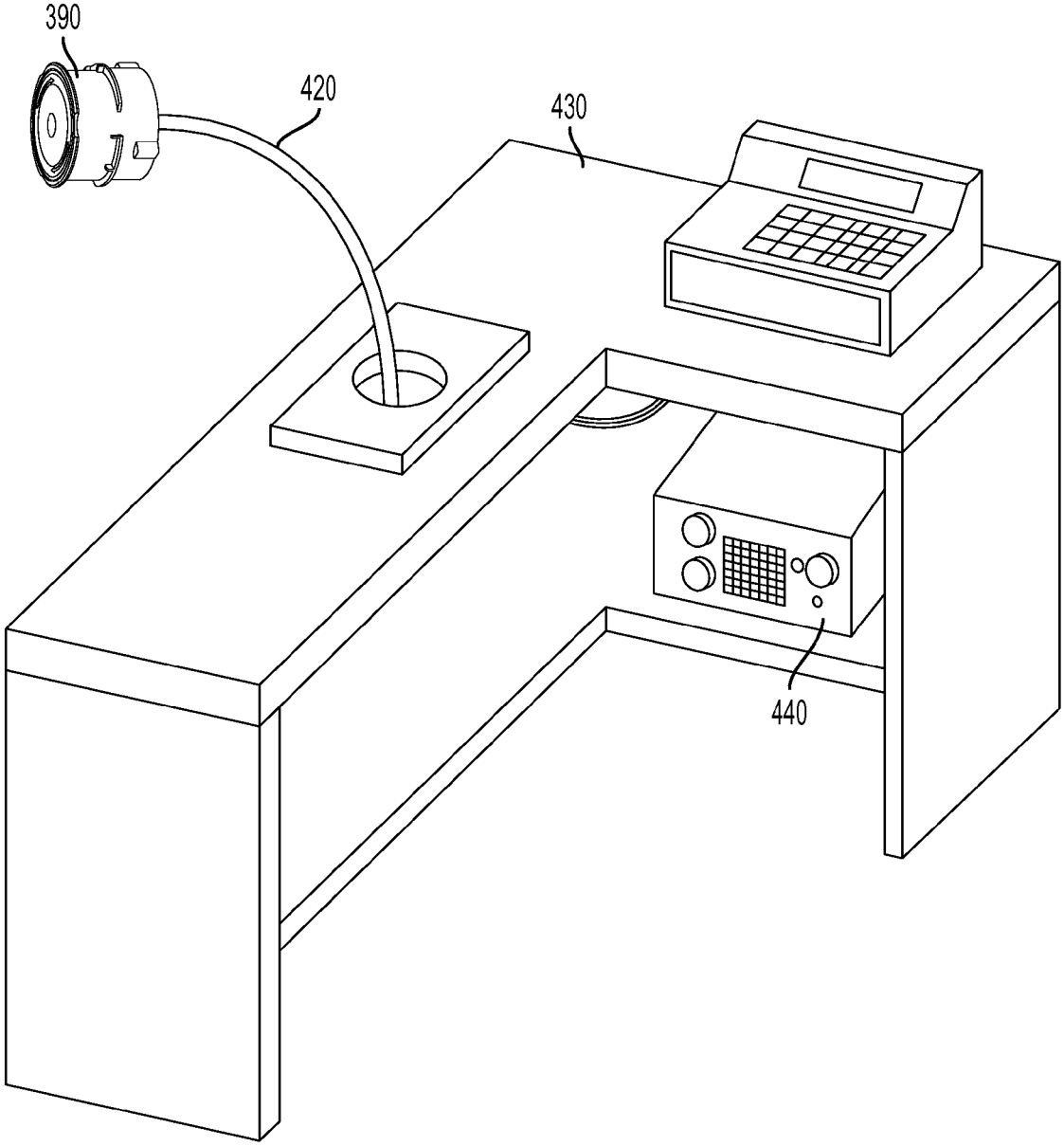
FIG. 7 shows the detacher of FIG. 12 in a retail location along with a base station.

FIG. 7 shows detacher 390 removed from its mount in a retail counter 430. In situations where the object being protected by EAS tag 10 is too large to be placed on a counter, detacher 390 may be extended from its typical position to be applied to the object and detach EAS tag 10. Smaller objects can be applied to detacher 390 as it is mounted in the retail counter 430. Cable 420 can communicate between detacher 390 and base station 440.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An anti-theft tag comprising;

a first component hingably connected to a second component, said first and second components rotatable between open and closed positions and, when in said closed position defining a passageway for receipt of a portion of an article to be protected;

said first component comprising a first latching component and a housing defining an internal compartment with a switch aperture passing from said internal compartment to external of said housing;

electronics located within said internal compartment, said electronics comprising a closure switch, said closure switch extending through said switch aperture in said housing;

said second component comprising a second latching component;

said second component changing the state of said closure switch when said first component and said second component rotate to said closed position, and said first and second latching components combining to maintain said first and second components in said closed position when said latching components engage.

2. The anti-theft tag of claim 1, wherein:

said latching components are releasably lockable in engagement.

3. The anti-theft tag of claim 2, wherein:

said releasably lockable latching components may be unlocked by application of a magnet.

4. The anti-theft tag of claim 1, wherein:

said first latch component is a manually operated sliding latch movable between an engaged position and a disengaged position;

said anti-theft tag further comprising a biased blocking component, said biased blocking component moving to a blocking position when said sliding latch is manually slid to said engaged position, thereby blocking the return of said sliding latch;

said biased blocking component being movable to a non-blocking position by application of a magnet to a magnetically attractable element associated with said biased blocking component, the moving of said biased blocking component to a non-blocking position allowing said sliding latch to be manually moved to said disengaged position.

5. The anti-theft tag of claim 1, wherein:

said electronics further comprise a circuit board, a microprocessor, communication elements, an audible alarm generator, and a battery.

6. The anti-theft tag of claim 5, wherein:

if said electronics detect a change in the status of said closure switch without authorizing communication being received by said communication elements in said electronics, said electronics determine an alarm condition and generate an alarm.

7. The anti-theft tag of claim 6, wherein;

said alarm is an audible alarm.

8. The anti-theft tag of claim 6, wherein;

said alarm is an alarm signal broadcast by said communication elements for receipt by devices external to said anti-theft tag.

9. The anti-theft tag of claim 5, wherein;

said electronics further comprise a latch switch;

said latch changing the state of said latch switch and arming said tag when said first and second components are in said closed position and said latch is moved to said engaged position.

10. The anti-theft tag of claim 5, wherein;

said communication elements are capable of communicating with external devices to receive signals changing said anti-theft tag between armed and disarmed states.

11. The anti-theft tag of claim 5, further comprising:

machine readable instructions encoded in said microprocessor for storing a passcode.

12. The anti-theft tag of claim 11, wherein:

said electronics further comprise an accurate clock generator, and said machine readable instructions further comprise an algorithm for generating multiple passcodes, wherein at specific time intervals said algorithm generates a new passcode and a previously stored passcode is replaced by said new passcode.

13. The anti-theft tag of claim 1, further comprising;

a passive electronic article surveillance element.

14. An anti-theft tag comprising;

a housing defining an internal compartment with a switch aperture passing from said internal compartment to external of said housing, said housing having a first latching component;

a first hinge extending from said housing;

electronics located within said internal compartment, said electronics comprising a closure switch, said closure switch extending through said switch aperture in said housing;

a panel having a second latching component;

a second hinge extending from said panel, said first hinge and said second hinge pivotably connected to each other and rotatable between open positions and a closed position, said first hinge and said second hinge combining when in said closed position to form a passageway to receive a portion of an object to be protected;

said panel actuating said closure switch when said first and second hinges rotate to said closed position;

said first and second latching components combining to maintain said first and second hinges in said closed position when said latching components engage.

15. The anti-theft tag of claim 14, wherein:

said electronics further comprise a circuit board, a microprocessor, communication elements, an audible alarm generator, and a battery.

16. The anti-theft tag of claim 15, wherein;

if said electronics detect a change in the status of said closure switch without authorizing communication being received by said communication elements in said electronics, said electronics determine an alarm condition and generate an alarm.

17. The anti-theft tag of claim 16, wherein;

said first latch component is a manually operated sliding latch movable between an engaged position and a disengaged position;

said anti-theft tag further comprising a biased blocking component, said biased blocking component moving to a blocking position when said sliding latch is manually slid to said engaged position, thereby blocking the return of said sliding latch;

said biased blocking component being movable to a non-blocking position by application of a magnet to a magnetically attractable element associated with said biased blocking component, the moving of said biased blocking component to a non-blocking position allowing said sliding latch to be manually moved to said disengaged position.

18. An anti-theft tag comprising;

a first component hingably connected to a second component, said first and second components rotatable between open and closed positions and, when in said closed position defining a passageway for receipt of a portion of an article to be protected, said first component comprising a housing defining an internal compartment and a sliding latch, said sliding latch movable between a latched position and an unlatched position, and, said second component comprising a latch receiver for receiving said sliding latch when said first and second components rotate to said closed position and said sliding latch moves to said latched position;

electronics located within said internal compartment;

a blocking component; and, a spring;

said spring moving said blocking component into a blocking position to prevent the return of said sliding latch when said first component and said second component rotate to said closed position, and said sliding latch moves to said latched position.

19. The anti-theft tag of claim 18, wherein;

said blocking component comprises a magnetically attractable material and can be moved from said blocking position by application of a magnet to said anti-theft tag.

20. The anti-theft tag of claim 18, wherein;

said electronics comprise a passive electronic article surveillance element.

21. The anti-theft tag of claim 18, wherein;

said first component further comprises a switch aperture passing from said internal compartment to external of said housing;

said electronics comprise a circuit board, microprocessor, battery, audible alarm generator, and a closure switch, said closure switch extending through said switch aperture in said housing; and, said second component changes the state of said closure switch when said first and second components are moved to said closed position.

* * * * *